US005249694A

United States Patent [19]

Nelson

[11] Patent Number: 5,249,694

[45] Date of Patent: Oct. 5, 1993

[54] TEAR STRIP CONTAINER

[75] Inventor: James L. Nelson, Temple City, Calif.

[73] Assignee: Highland Plastics, Inc., Pasadena, Calif.

[21] Appl. No.: 820,114

[22] Filed: Jan. 13, 1992

Related U.S. Application Data

[63] Continuation-in-part of Ser. No. 718,395, Jun. 20, 1991, abandoned.

[51] Int. Cl.[5] ..... B65D 17/40

[52] U.S. Cl. ..... 220/276; 220/266; 220/306

[58] Field of Search ..... 215/32, 256, 253, 254; 220/276, 306, 266; 229/212, 235, 237

[56] References Cited

U.S. PATENT DOCUMENTS

| | | | |
|---|---|---|---|
| 4,024,976 | 5/1977 | Acton | 215/32 |
| 4,190,175 | 2/1980 | Allen | 220/270 |
| 4,711,364 | 12/1987 | Letica | 220/276 |
| 5,027,969 | 7/1991 | Lesguir | 220/270 |

*Primary Examiner*—Stephen P. Garbe
*Assistant Examiner*—Nova Stucker
*Attorney, Agent, or Firm*—David O'Reilly

[57] ABSTRACT

A tamper evident container having an easily removable tear strip that snugly fits around the rim or skirt of a lid. The tear strip has a break away tab and is joined to the wall of the container by a series of thin rupturable links. The strip snugly holds the lid on the container preventing removal without some evidence of tampering but may be easily stripped away to allow use of the contents of the container.

8 Claims, 2 Drawing Sheets

TEAR STRIP CONTAINER

This application is a continuation-in-part of Ser. No. 07/718,395, filed Jun. 20, 1991, now abandoned.

FIELD OF THE INVENTION

This invention relates to a tamper resistant container lid having a tamper resistant container having a removable tamper evident tear strip.

BACKGROUND OF THE INVENTION

Many methods have been conceived in recent years to prevent package tampering. Such methods including sealing the container with a product that will make the container tamper evident. These devices include various types of seals and wraps that will immediately provide evidence of tampering if any attempt is made to remove them. Such tamper evident seals provide a warning to potential users. Other devices include tear strips around the lids or caps on containers. The tear strip breaks away and can be torn off allowing removal of the lid. Any attempt to pry the lid off will result in damage to the tear strip providing evidence of tampering.

Most of the devices presently available concentrate on some way on sealing the lid to containers with shrink wrap devices or with tear strips. It would be advantageous, however if the tear strip could be incorporated into the container itself allowing the use of standard lids. There are devices provided on a container that block access to the lip of the lid preventing the lid from being removed without evidence of tampering. With these devices a collar or flange is provided that blocks the peripheral edge around the skirt on the lid preventing the lid from being easily removed. A small break away flange is provided on a portion of the blocking flange that can be removed to get a grip on the edge of the lid for removal. A tab on the blocking flange is joined by two thin sections. A downward pressure on the flange causes it to rupture and break away allowing the person to grip the edge of the lid for removal. However these devices are not very effective as the lid can be pried off relatively easy without damaging the barrier created by the flange. It would be advantageous if the flange or collar could be constructed on the container to snugly seal the periphery of the lid. It would also be advantageous if it could be completely removed after the container is opened.

Also most containers that have tamper evident strips just have a breakaway portion and leave all or a substantial portion of the strip on the container. Preferably the tamper evident strip should tear completely away leaving a clean standard container.

It is therefore one object of the present invention to provide a tear away flange or collar on a container that snugly seals the periphery of a lid.

Yet another object of the present invention is to provide a tamper evident strip on a container that allows standard lids to be used.

Still another object of the present invention is to provide a tamper evident strip on a container that seals around the periphery of a cup lid and substantially prevents removal of the lid without any evidence of tampering damage to the strip.

The above and other novel features and advantages of the invention will be more fully understood from the following detailed description and the accompanying drawings in which:

BRIEF DESCRIPTION OF THE INVENTION

The purpose of the present invention is to provide a container with a tamper evident tear strip that is constructed to be completely removed and leave a standard container and includes a lid construction that makes it difficult to defeat the safety tamper evident strip construction.

The container is provided with a flanged strip around the open top of the cup that has a plurality of sections forming links that can be ruptured to tear away the strip. The tear a way strip resists removal of the lid without showing some evidence of tampering. To do this the strip is attached to the container with a section that has alternating thin rupturable links and slots. The rupturable links are thinner where the join the side of the container and the slots spread toward the rupturable links to provide what amounts to a "pre-torn" section at each end of the rupturable links. This facilitates complete removal of the tear safety strip leaving a clean reusable container.

Preferably the slots are at least twice the length of the rupturable links which provides an firm connection but is easily ruptured by a lateral force. The "pre-torn" sections do not substantially weaken the attachment but make easy to completely remove the tamper resistant strip.

The tamper resistant tear strip includes an ridge around the interior surface to mate with a shoulder around the lower edge of the lid to resist the removal of the lid with a prying tool. The shoulder locks beneath the ridge in the interior of the tear strip and is not visible. It can deceive a tamperer into thinking the end of a pry tool inserted inside the tear strip is below the edge of the lid when in reality it is pressing down on the shoulder on the edge of the lid. The combination of the ridge in the inside of the tear strip and shoulder on the edge of the lid frustrates attempts to force a pry tool underneath the edge of the lid.

DETAILED DESCRIPTION OF THE INVENTION

Figure 1:
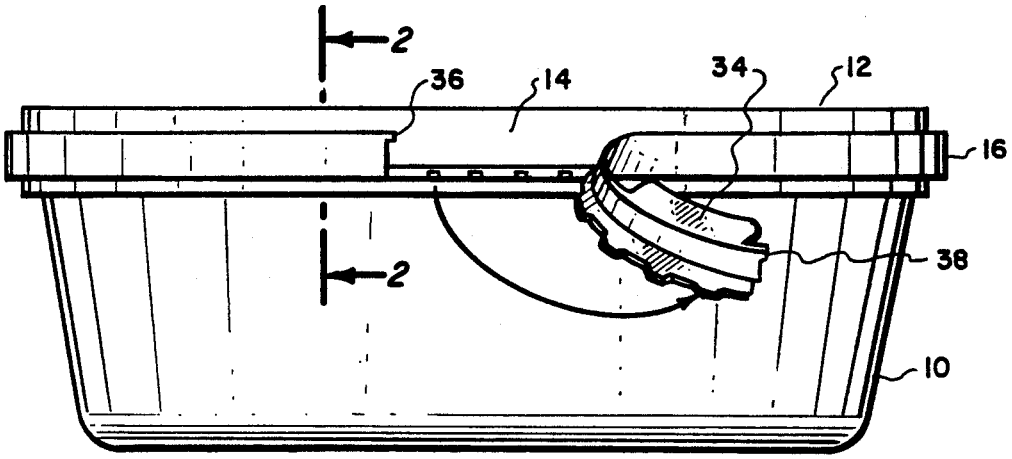
FIG. 1 is a side elevation of a cylindrical container incorporating the tamper evident tear away strip according to the invention.

A tamper evident container is illustrated in FIG. 1 and is comprised of a plastic concave vessel or cup 10 having a standard plastic flanged lid 12. Cups 10 come in a variety of sizes and are used for packaging food products. Because such containers have been the target of tampering and contaminating the edible products contained in them tamper evident containers are now widely used. Most of these tamper evident containers have some type of seal around the flange 14 of the lid that prevents removal of the lid without evidence of tampering.

It was determined that it would be advantageous if the tamper evident seal could be provided on the cup 10 rather than on the lid 12. For that reason a tamper evident L-shaped flange 16 is provided around the periphery of cup 10 to seal the skirt or flange 14 of lid 12. Lid 12 is provided with a ridge 18 around the circumference of the inner surface 20 on flange 14. The ridge 18 snaps over a similar ridge 22 formed around the periphery of the upper edge of cup 10.

To seal the lid 14 on cup 10 L-shaped collar or flange 16 is formed around the periphery of the cup forming an annulus 24 for receiving the skirt or flange 14 on lid 12. The vertical portion of collar or flange 16 covers a substantial portion of the skirt or flange 14 of lid 12 completely covering lower edge 15 of the lid. This prevents the lid from being pried off with the fingers or any type of tool without some damage to tamper evident flange 16.

Figure 2:
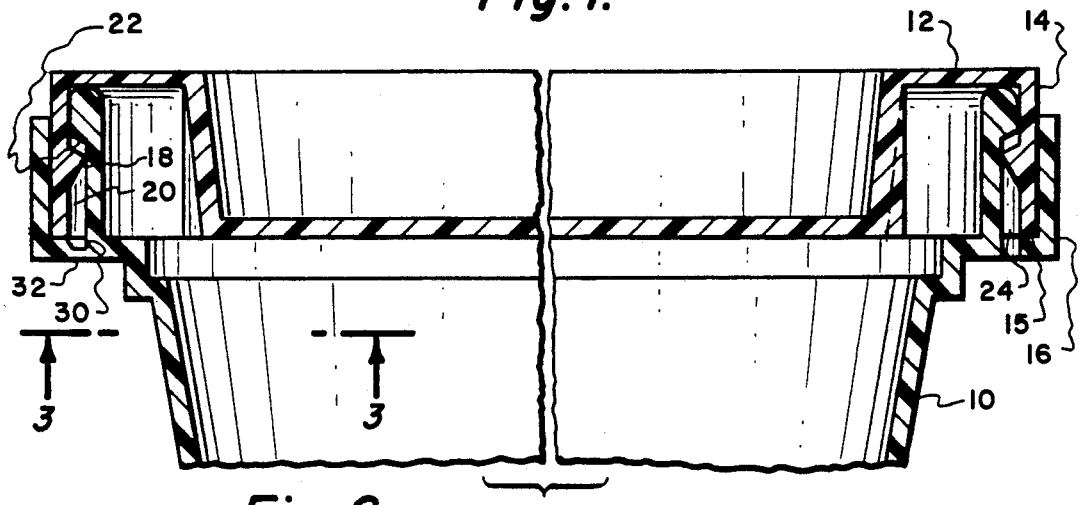
FIG. 2 is a sectional view illustrating the construction of the tamper evident strip.
Figure 3:
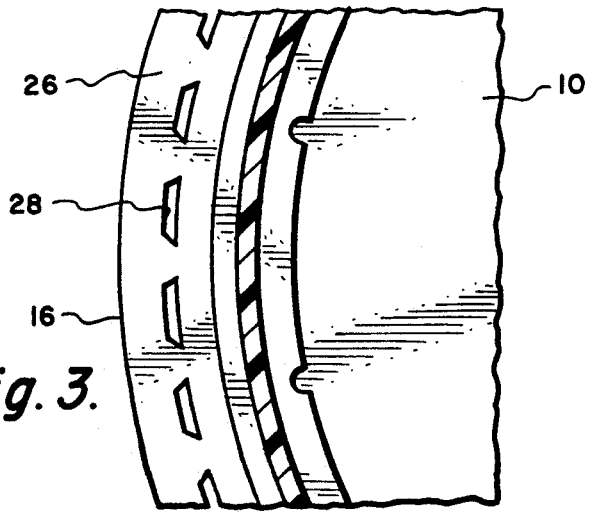
FIG. 3 is a partial sectional view taken at 3—3 illustrating the construction of the tamper evident strip.

Flange 16 is integrally formed on cup 10 in a molding process. A series of gates form thin adjoining sections or links 26 and open slots 28 around the periphery of flange where it is attached to shoulder 30 on cup 10. Preferably cup 10 is made of a linear polyethylene with a ratio of slots 28 to thin links 26 formed by gates being approximately 2 to 1. The links 26 are also formed by gates in the mold which result in a thinner section as shown at 32 in FIG. 2. Thus an easily ruptured secure flange 16 is formed around the upper edge of cup 10 for receiving flange 14 on lid 12. Flange 16 also includes a thumb tab 34 for initially rupturing the flange 16. Small links 36 and 38 join flange 16 at tab 34. Thus flange 16 provides an easily removable tear strip that securely seals the periphery of lid 12 to prevent removal without evidence of tampering.

To remove lid 12 to gain access to cup 10 a downward pressure is applied to tab 34 rupturing links 36 and 38. The flange or strip 16 may then be completely removed from the cup by pulling the strip away from the cup. This results in a nice clean container having a standard lid 12 for convenient use by the consumer.

Figure 4:
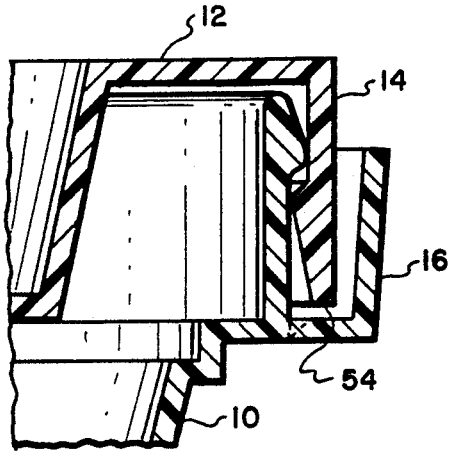
FIG. 4 is a partial sectional view of a cylindrical container with a lid attached.
Figure 5:
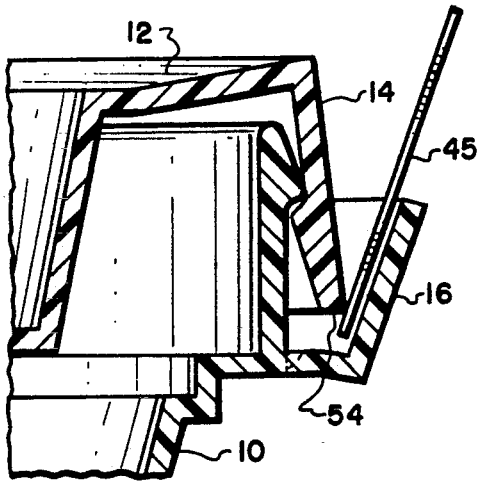
FIG. 5 is a partial sectional view similar to FIG. 4 illustrating how the usual tamper resistant designs may be defeated.
Figure 6:
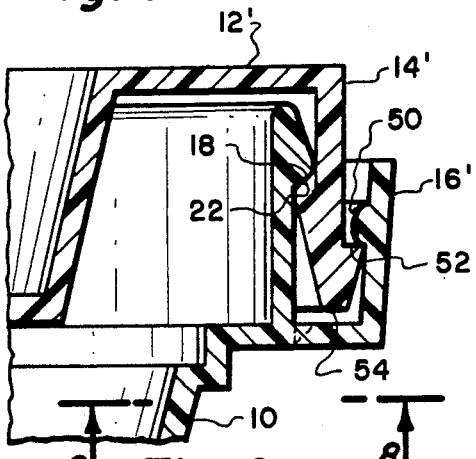
FIG. 6 is a partial sectional view of a modified tamper resistant cylindrical container and lid to resist the use of a prying tool to defeat the safety design.
Figure 7:
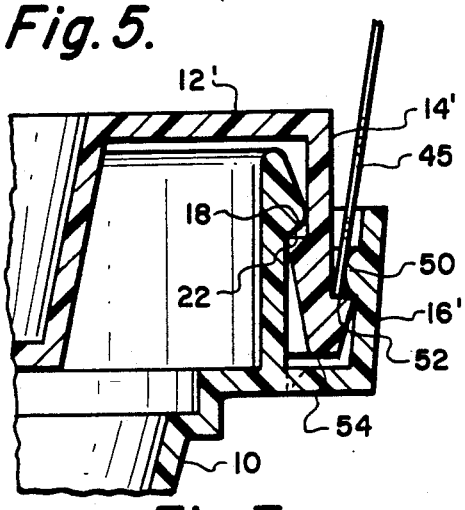
FIG. 7 is a partial sectional view similar to FIG. 6 illustrating how the modified container and lid resist prying the lid off without producing tamper evident damage.
Figure 8:
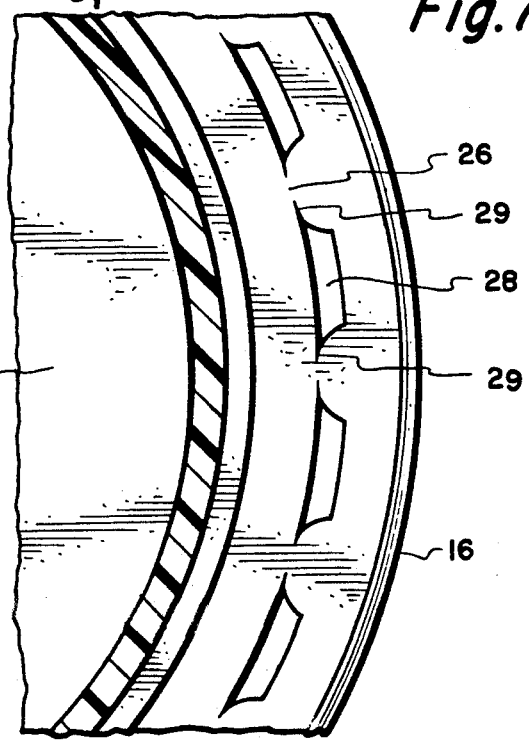
FIG. 8 is an enlarged sectional view similar to FIG. 3 illustrating the construction of the open slots to facilitate easy and complete removal of the tear strip from the container.

FIGS. 6 and 7 illustrate a modified version of the tamper resistant container and lid to prevent defeating the usual tamper resistant designs shown in FIGS. 4 and 5. In FIG. 4 and 5 the usual container 10, having a tamper resistant lid 12 with a peripheral skirt or flange 14 engages a tamper resistant tear strip 16. The flange 14 of the lid seats in the tear strip. While the lid 12 is not easily removed it has been found that the tamper resistance might be overcome by using a tool 45 as shown in FIG. 5. By carefully inserting a tool 45 inside the periphery of tear strip 16, the lower edge of flange 14 can be pried up and around the rim of container 10. By carefully working the tool around the container inside the periphery of the tear strip, the lid, it has been found, can be removed without damage to the tear strip. It requires great care and would only be done by someone having great skill and determination. However, it demonstrates how the usual tamper resistant tear strips are subject to being defeated.

For that reason the tear strip and lid may be modified as shown in FIGS. 6 and 7. In this embodiment tear strip 16' would have an interior peripheral ridge or bump 50 around the entire interior surface of tear strip 16'. Lid 12' has a flange or skirt 14 that includes an additional shoulder on the lower end or edge of flange 14' that engages ridge 50 on the tear strip providing an interference fit. This locks lid 12' onto container 10 by ridge 18 engaging ridge 22 with shoulder 52 engaging ridge 50 inside tear strip 16'. This provides a double locking feature substantially preventing removal of lid 12' without damage to tear strip 16'.

The modified lid of FIG. 6 substantially prevents removal of the lid with a tool as shown in FIG. 7. Any attempt to pry off lid 12' with tool 45 will be prevented by the interference fit of shoulder 52 locked beneath ridge 50. Any attempt to slide tool 45 beneath the edge 54 of flange 14' is prevented by shoulder 52 and ridge 50. Ridge 50 tends to push the tool 45 toward the flange or lid while the shoulder 52 prevents the end of the tool from getting down beneath the end or edge 54 of lid 12'. The only way a tool 45 could be forced down beneath lid 12' is to bend tear strip 16' severely causing damage to the tear strip leaving evidence of tampering.

The ridge 50 on the inside surface of the flange 14' and the shoulder 52 on the lower outside edge of lid 12' deceives a potential tamperer when any attempt is made to remove the lid with a prying tool. For all appearances the intersection of the shoulder 52 with flange 14' on lid 12 appears to be the edge of the lid when it is not. Thus when the end of prying tool 45 is inserted inside tear strip 16' the end of the tool runs into shoulder 52 which appears to be the bottom of the tear strip 16' but is not. A downward force on the tool then actually pushes down on shoulder 52 pushing the lid down rather than prying the edge up frustrating attempts to gain entrance to the contents of the container.

The tear strip 16 or 16' is constructed to be completely removable to leave a completely standard cup and lid after the safety tear strip has been removed. The ratio of stops 26 to slots 28 facilitates this removal with the design of the slots 28 enhancing the ability to completely and cleanly remove the tear strip. The tear strip 16 is molded so that slots 28 form sharp corners or slits 29 at each end. This in conjunction with the ratio of stops to slots causes the plastic to easily tear and break clean from the cup 10. In this manner a clean completely standard cup is left after tear strip 16 is removed. The action of the sharp corners or slits 29 in slots 28 works much like precutting material with scissors before trying to tear it. The slits 29 act as tear initiators when a relatively light lateral force is applied to the tear strip.

Thus there has been described a tamper evident container in which a tamper resistant flange is provided on the cup to seal the periphery of a standard lid. Any attempt to pry off the lid will result in damage to the tamper evident flange. Once ruptured the flange is easily removed by tearing it away from the outside surface of the cup. A standard container having an easily removable standard lid is now provided.

This invention is not to be limited by the embodiment shown in the drawings and described in the description which is given by way of example and not of limitation, but only in accordance with the scope of the appended claims.

What is claimed is:

1. A tamper evident container for storing food products comprising;

a concave circular container having an open end;

a lid having a peripheral flange fitting over the open end of said container;

said container having a peripheral ridge around a lip on the open end of said container for securing said lid;

a removable flanged strip formed around an outside upper edge of said container;

said removable flanged strip covering a substantial portion of said flange on said lid when said lid is mounted on said container;

said removable flanged strip comprising, an L-shaped flange forming an upward oriented annulus for receiving and substantially covering said peripheral flange on said lid, said L-shaped flange being joined to said container by a plurality of easily ruptured links defined by a plurality of slots so that said flanged strip may easily be completely removed from said container;

pry preventing means for preventing an edge of said lid being pried up prior to removal of at least a section of said removable flanged strip;

said pry preventing means comprising a shoulder extending outwardly from said peripheral flange on said lid; and a ridge extending inwardly from an upwardly directed wall of said flanged strip, said shoulder forming an interference fit with said ridge when said lid is mounted on said container so that an edge of said lid flange is concealed to prevent prying;

whereby said removable flanged strip substantially prevents removal of said lid without evidence of tampering.

2. The container according to claim 1 in which said rupturable links of said flanged strip are substantially thinner than the thickness of said remainder of said flanged strip.

3. The container according to claim 2 in which the circumferential slots is greater than the circumferential length of said rupturable links.

4. The container according to claim 3 in which the ratio of the circumferential length of said slots to said links is approximately 2 to 1.

5. A tamper evident container for storing food products comprising;

a concave circular container having an open end;

a lid having a peripheral flange fitting over the open end of said container;

said container having a peripheral ridge around a lip at the open end of said container for securing said lid;

a removable flanged strip formed around substantially the entire circumference of an outside upper edge of said container below said peripheral ridge;

said removable flanged strip covering a substantial portion of said lid flange when said lid is mounted on said container;

said removable flanged strip comprising, an L-shaped flange forming an upward oriented annulus for receiving and substantially covering said peripheral flange on said lid, said L-shaped flange being joined to said container by a plurality of easily ruptured links which are substantially thinner than the thickness of the remainder of said flanged strip so that said flanged strip may easily be completely removed from said container;

said rupturable links being defined by a plurality of slots around substantially an entire circumferential periphery of said removable flanged strip; said slots defining acutely angled sharply tapered corners at each end of each of said rupturable links joining said removable flanged strip to said container so that said sharply tapered corners act as tear initiators to facilitate complete removal of said flanged strip;

whereby said removable flanged strip substantially prevents removal of said lid without evidence of tampering.

6. The container according to claim 5 in which the circumferential length of said slots is greater than the circumferential length of said rupturable links.

7. The container according to claim 6 in which the circumferential length of said slots is approximately twice the circumferential length of said rupturable links.

8. The container according to claim 7 including means to prevent prying said lid off said container, said pry preventing means comprising a shoulder extending outwardly from said peripheral flange on said lid forming an interference fit with a ridge extending inwardly from an upwardly directed wall of said flanged strip so that a prying tool may not be inserted beneath an edge of said lid.

* * * * *